United States Patent [19]

Gruber et al.

[11] Patent Number: 4,464,452

[45] Date of Patent: Aug. 7, 1984

[54] DEVELOPER COMPOSITIONS CONTAINING DIARYL SULFONIMIDES

[75] Inventors: Robert J. Gruber, Pittsford; Paul C. Julien, Webster; Raymond A. Yourd, III, Rochester, all of N.Y.

[73] Assignee: Xerox Corporation, Stamford, Conn.

[21] Appl. No.: 490,264

[22] Filed: May 2, 1983

[51] Int. Cl.[3] ..... G03G 9/08; G03G 9/10

[52] U.S. Cl. ..... 430/110; 430/106; 430/106.6; 430/107; 430/126

[58] Field of Search ..... 430/110, 126, 106, 106.6, 430/107

[56] References Cited

U.S. PATENT DOCUMENTS

| | | | |
|---|---|---|---|
| 3,577,345 | 5/1971 | Jacknow et al. | 430/110 |
| 3,893,934 | 7/1975 | Braun et al. | 430/110 |
| 3,893,935 | 7/1975 | Jadwin et al. | 252/62.1 |
| 4,002,776 | 1/1977 | Braun et al. | 430/110 |
| 4,073,980 | 2/1978 | Westdale et al. | 428/404 |
| 4,298,672 | 11/1981 | Lu | 430/108 |
| 4,338,390 | 7/1982 | Lu | 430/106 |

*Primary Examiner*—Mary F. Downey
*Attorney, Agent, or Firm*—E. O. Palazio

[57] ABSTRACT

Developer composition with a negative charge enhancing additive is disclosed.

31 Claims, No Drawings

DEVELOPER COMPOSITIONS CONTAINING DIARYL SULFONIMIDES

BACKGROUND OF THE INVENTION

This invention is generally directed to developer compositions, and more specifically the present invention is directed to developer compositions, and toner compositions, which contain therein as negative charge enhancing additives certain diaryl or dialkyl sulfonimides. In one embodiment of the present invention there is thus provided toner compositions comprised of resin particles, pigment particles, and dibenzene sulfonimides as negative charge enhancing additives. The sulfonimides impart a negative charge to the toner resin particles, allowing the resulting developer compositions to be selected for use in the development of colored xerographic images.

There is disclosed in the prior art the use of charge control materials for the purpose of providing a positive charge to the toner resin particles. Thus, there is described in U.S. Pat. No. 3,893,935 the use of certain quaternary ammonium compounds as charge control additives for electrostatic toner compositions. Additionally, there is disclosed in U.S. Pat. No. 4,298,672, toner compositions containing as positive charge enhancing additives alkyl pyridinium halides, including cetyl pyridinium chloride. Further described in U.S. Pat. No. 4,338,390 are toner compositions including therein as a positive charge enhancing additive various organic sulfate or sulfonates, such as stearyl dimethyl phenethyl ammonium tosylate.

Furthermore, disclosed in copending applications are toner and developer compositions containing as charge enhancing additives orthohalophenylcarboxylic acids, which additives impart a negative charge to the toner resin particles, and negatively charged toner compositions having incorporated therein aryl sulfones. While other negative charge controlling additives may be known, there nevertheless continues to be a need for the development of new negative charge enhancing additives. Additionally, there is a need for toner compositions containing negative charge enhancing additives wherein there is imparted in a rapid time period high negative charges to the toner resin particles. Furthermore, there continues to be a need for colored developer compositions containing therein negative charge enhancing additives which do not adversely affect the colored pigments, such as magenta, cyan and/or yellow compositions contained therein.

SUMMARY OF THE INVENTION

It is an object of the present invention to provide developer compositions containing negative charge enhancing additives.

In a further object of the present invention there are provided toner and developer compositions having incorporated therein certain aryl sulfonimides as negative charge enhancing additives.

In yet a further object of the present invention there are provided toner compositions, containing resin particles, pigment particles, and as negative charge enhancing additives certain sulfonimide compositions.

In a further object of the present invention there are provided toner compositions containing as negative charge enhancing additives various dibenzene sulfonimides.

In yet a further object of the present invention there are provided toner compositions containing therein cyan, magenta, or yellow pigments, as well as mixtures thereof, and as a negative charge enhancing additive dibenzene sulfonimides.

Another object of the present invention resides in the provision of a developer composition comprised of resin particles, carrier particles, pigment particles of carbon black, magenta pigments, cyan pigments, yellow pigments, or mixtures thereof, and as a negative charge enhancing additive various dibenzene sulfonimides.

In yet a further object of the present invention there are provided methods of developing images, including color images, with developer compositions comprised of resin particles, carrier particles, pigment particles, and sulfonamide charge enhancing additives.

In still another object of the present invention there are provided developer and toner compositions having incorporated therein in addition to the sulfonimide charge enhancing additives magnetic particles such as magnetites containing a mixture of iron oxides.

These and other objects of the present invention are accomplished by the provision of a negatively charged toner composition, and developer compositions thereof, wherein the toner composition is comprised of resin particles, colorant and/or pigment particles, and an aryl sulfonimide negative charge enhancing additive of the formula:

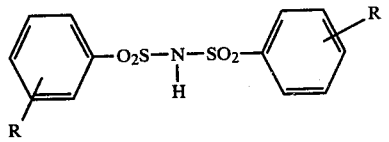

wherein R and $R_1$ are independently selected from the group consisting of alkyl groups, halogen, nitro groups, hydrogen, and the like.

Illustrative examples of alkyl groups include those containing from about 1 to about 25 carbon atoms, such as ethyl, methyl, propyl, butyl, pentyl, hexyl, octyl, nonyl, decyl, myristyl, cetyl, oleyl, pentadecyl, heptadecyl, stearyl, and the like. Preferred alkyl groups for $R_1$ and $R_2$ include methyl, ethyl, propyl and butyl.

Examples of halogen substituents for R and $R_1$ are fluoride, chloride, iodide, or bromide, with chloride being preferred.

Illustrative specific examples of aryl sulfonimides included within the scope of the present invention are di-tolyl sulfonimide, phenyl tolyl sulfonimide, diphenyl sulfonimide, and the like, the preferred additive being di-tolyl sulfonimide. Other sulfonimides disclosed include di-1-naphthyl sulfonimide, di-2-naphthyl sulfonimide, benzene-1-naphthyl sulfonimide, hexadecyl tolyl sulfonimide, methyl tolyl sulfonimide, various dialkyl sulfonimides, including dihexadecyl sulfonimide.

The aryl sulfonimide negative charge enhancing additives of the present invention can be selected for incorporation into toner compositions, and developer compositions in various amounts, provided they do not adversely affect these compositions, and result in a toner that is negatively charged in comparison to the carrier particles. Thus, for example, the amount of aryl sulfonimide selected vary from about 0.1% by weight to about 10% by weight of the toner particles, and preferably this amount is from about 0.5% by weight to about 5% by weight of the toner particles. In one preferred embodiment of the present invention, the aryl sulfonimide negative charge enhancing additives are present in an amount of from about 1% by weight to about 5% by weight.

The aryl sulfonimide charge enhancing additives of the present invention can be incorporated into the toner and developer compositions by various known methods including blending of the additive with the toner resin particles, or alternatively the charge enhancing additive can be coated on the colorant or pigment particles, such as carbon black, cyan pigment, magenta pigment, or yellow pigment, selected as a colorant or pigment for the toner composition. When used as a coating, the charge enhancing additive of the present invention is present in an amount of from about 2 weight percent to about 20 weight percent, and preferably in an amount of from about 5 weight percent to about 10 weight percent.

Various methods can be selected for preparing the toner and developer compositions of the present invention, one method involving melt blending the resin particles and pigment particles, followed by mechanical attrition. Other methods include those well known in the art such as spray drying, melt dispersion, dispersion polymerization, suspension polymerization, and the like. In dispersion polymerization a solvent dispersant of resin particles, pigment particles, and the dibenzene sulfonimide charge enhancing additive of the present invention are sprayed dried under controlled conditions resulting in the desired product. A toner prepared in this manner results in negatively charged toner resin particles, in relation to the carrier materials present in the developer compositions, and these compositions exhibit the improved properties as mentioned hereinbefore.

Various suitable resins can be selected for the toner compositions of the present invention. Typical resins include, for example, thermoplastic materials, such as polyamides, epoxies, polyurethanes, vinyl resins, and polyesters, especially those prepared from dicarboxylic acids and diols comprising diphenols. Any suitable vinyl resin may be employed in the toners of the present system, including homopolymers or copolymers of two or more vinyl monomers. Typical of such vinyl monomeric units include: styrene, p-chlorostyrene, vinyl naphthalene, ethylenically unsaturated monoolefins such as ethylene, propylene, butylene, isobutylene and the like; vinyl halides such as vinyl chloride, vinyl bromide, vinyl fluoride, vinyl esters such as vinyl acetate, vinyl propionate, vinyl benzoate, vinyl butyrate and the like; esters of aliphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methylalphachloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene, styrene butadiene resins, and the like; and mixtures thereof.

Generally toner resins containing relatively high percentages of styrene are preferred. The styrene resin may be a homopolymer of styrene, or of styrene homologs of copolymers of styrene with other monomeric groups. Any of the above typical monomeric units may be copolymerized with styrene by addition polymerization. Styrene resins may also be formed by the polymerization of mixtures of two or more unsaturated monomeric materials with a styrene monomer. The addition polymerization technique embraces known polymerization techniques such as free radical, anionic, and cationic polymerization process. These vinyl resins may be blended with one or more other suitable resins if desired, preferably other vinyl resins, which insure good triboelectric properties and uniform resistance against physical degradation. However, non-vinyl type thermoplastic resins may also be selected including resin modified phenolformaldehyde resins, oil modified epoxy resins, polyurethane resins, cellulosic resins, polyether resins, and mixtures thereof.

Also esterification products of a dicarboxylic acid, and a diol comprising a diphenol may be used as a preferred resin material for the toner composition of the present invention. These materials are illustrated in U.S. Pat. No. 3,655,374, the disclosure of which is totally incorporated herein by reference, the diphenol reactant being of the formula as shown in Column 4, beginning at line 5, of this patent, and the dicarboxylic acid being of the formula as shown in Column 6.

The resin particles are present in an amount that provides a total of about 100 percent for all toner ingredients, thus when 5 percent by weight of the charge enhancing composition of the present invention is present, and 10 percent by weight of pigment or colorant particles such as carbon black are present, about 85 percent by weight of resin material is incorporated into the toner composition.

With regard to developer compositions selected for the development of electrostatic latent images wherein there results a black image, various suitable pigments or dyes can be utilized as the colorant for the toner particles, such materials being well known, and including, for example, carbon black, magnetite, iron oxides, nigrosine dye, and the like. The pigment or dye should be present in the toner composition in sufficient quantity so as to render it highly colored, thus allowing the toner composition to create a clearly visible image on the recording member. Thus, for example, when conventional xerographic copies of documents are desired, the toner composition may include in an effective amount a black pigment, such as carbon black, or a black dye such as Amaplast black dye available from the National Aniline Products, Inc. Preferably the pigment particles are present in amounts of from about 3 percent to about 50 percent by weight based on the total weight of the toner particles, however, if the pigment selected is a dye, substantially smaller quantities, for example, less than 10 percent by weight, may be used.

With regard to developer compositions utilized for obtaining color images, there is selected as the colorant or pigment particles cyan pigments, magenta pigments, yellow pigments, or mixtures thereof. Illustrative examples of useful cyan pigments include copper tetra-4-(octadecylsulfonomido)phthalocyanine, the X-copper phthalocyanine pigment listed in the color index as CI 74160, CI Pigment Blue 15, an Anthradanthrene blue identified in the color index as CI 61890, Special Blue X-2137 and the like; while illustrative examples of yellow pigments that may be selected include diarylide yellow 3,3-dichloro benzidene acetoacetanilide a monoazo pigment identified in the color index as CI 12700, CI Solvent Yellow 16, a nitrophenyl amine sulfonimide identified in the color index as Foron Yellow SE/GLF, CI Dispersed Yellow 33, 2,5-dmethoxy-4-sulfonoanilide phenylazo-4-chloro-2,5-dimethoxy acetoacetanilide, permanent yellow FGL, and the like. Illustrative examples of magenta materials that may be selected as pigments, include, for example, 2,9-dimethyl substituted quinacridone and anthraquinone dye identified in the color index as CI 60710, CI Dispersed Red 15, a diazo dye identified in the color index as CI 26050, CI Solvent Red 19, and the like.

The cyan, magenta and yellow pigments, when utilized with the charge enhancing additives of the present invention are generally incorporated into the toner composition in an amount of from about 2 weight percent to about 30 weight percent, and preferably in an amount of from about 5 weight percent to about 15 weight percent, based on the weight of the toner particles.

Various suitable carrier particles can be incorporated into the developer composition of the present invention, providing that the toner particles are charged negatively in comparison to the carrier particles. Thus, the carrier particles are selected so as to acquire a charge of a positive polarity, and include materials such as steel, nickel, iron ferrites, silicon dioxide, and the like. The carrier particles may contain a coating such as polymers of styrene, methyl methacrylate, and silanes. Many of the typical carriers that can be used are described in U.S. Pat. No. 3,638,522 the disclosure of which is totally incorporated herein by reference. Also the nickel berry carriers described in U.S. Pat. Nos. 3,847,604 and 3,767,598 can be selected these carriers being nodular carrier beads of nickel characterized by surfaces of reoccurring recesses and protrusions, thus providing particles with a relatively large external area. The diameter of the carrier particles are from about 50 microns to about 1,000 microns, thus allowing the carrier to possess sufficient density and inertia to avoid adherence to the electrostatic images during the development process.

The carrier particles may be mixed with the toner composition in various suitable combinations, however, best results are obtained when about 1 part of toner particles to about 10 to about 200 parts by weight of carrier particles are utilized.

The toner and developer compositions of the present invention can be used to develop electrostatic latent images, including color images, on various suitable imaging surfaces, capable of retaining charge including, for example, conventional photoreceptor surfaces known in the art, such as inorganic photoconductors, like selenium, and layered photoresponsive devices, containing charge transport, and photogenerating layers, reference U.S. Pat. No. 4,265,990, the disclosure of which is totally incorporated herein by reference, wherein a positive charge resides on the photoresponsive surface, which method comprises contacting the electrostatic latent image with the developer composition of the present invention, followed by transferring the resulting image to a suitable substrate, and optionally permanently affixing the image by, for example, heat. In addition to selenium, illustrative examples of useful inorganic photoreceptors include halogen doped amorphous selenium materials, alloys of amorphous selenium, such as arsenic selenium, selenium tellurium, and the like, halogen doped selenium alloys, cadmium sulfide, zinc oxide, and the like. Amorphous selenium and a selenium arsenic alloy containing about 99.5 percent selenium and about 0.5 percent arsenic are preferred. Color images can be obtained using, for example, a single pass process as described in U.S. Pat. No. 4,312,932 the disclosure of which is totally incorporated herein by reference.

While some of the aryl sulfonimides of the present invention are commercially available, generally they are prepared by, for example, dissolving an appropriate sulfonimide such di-para toluene sulfonimide, and a aromatic sulfonyl halide, such as toluene sulfonyl chloride, in a suitable solvent, such as xylene. The reaction is effected at a temperature of from about 100 degrees centigrade to about 150 degrees centigrade. The reaction can be accomplished in the presence of a base or an acid acceptor, or alternatively, the acid acceptor can be added to the reaction mixture subsequent to cooling. Examples of acid acceptors that may be selected include sodium carbonate, potassium carbonate, and the like. On completion of the reaction, the resulting product is filtered therefrom followed by washing in, for example, an alcohol such as ethanol. The product obtained was identified by infrared analysis, NMR analysis, melting point data, and chemical analysis for carbon hydrogen, sulphur, nitrogen, and oxygen.

Generally the solvent selected can be any material that will dissolve the initial reactants, such solvents including in addition to xylene, toluene, chloroform, methylene chloride, and mixtures thereof. About 1 liter to 2 liters of solvent are used for each mole of reactant. Additionally the reactants are present in a molar ratio of from about 1:1 to about 1:2.

The following examples are being supplied to further define certain embodiments of the present invention, it being noted that these examples are intended to be illustrative only, and are not intended to limit the scope of the present invention. Parts and percentages are by weight unless otherwise indicated.

EXAMPLE I

A di-para-toluene sulfonimide was prepared by dissolving 1 mole of toluene sulfonyl chloride, and 1 mole of para-toluene sulfonimide in 1.5 liters of xylene. This mixture was then heated a temperature of 145° C., and heating was allowed to continue for 1 hour. Subsequently, the mixture was allowed to cool slightly to 135° C., and 1 mole of potassium carbonate was added slowly with stirring. The mixture was then filtered to remove the xylene, and the resulting white precipitate was boiled in ethanol for 15 minutes. After cooling, the mixture was filtered in order to remove ethanol, and the precipitated product was then dissolved in a large volume of water, and precipitated therefrom with hydrochloric acid. The resulting product was then filtered from the solution, washed with water, and dried. The product melting point 172 degrees centigrade to 173 degrees centigrade was identified as di-para-toluene sulfonimide, by infrared analysis and NMR analysis. Further, elemental chemical analysis for the resulting product indicated the following:

| Elemental Analysis | Carbon | Hydrogen | Nitrogen | Sulphur |
|---|---|---|---|---|
| Theory | 51.67 | 4.65 | 4.31 | 19.67 |
| Found | 51.87 | 4.80 | 4.28 | 19.75 |

EXAMPLE II

A colored cyan toner composition was prepared by melt blending followed by mechanical attrition, which composition contained 93 percent by weight of a styrene/n-butyl methacrylate resin, containing 58 percent by weight of styrene, and 42 percent by weight of n-butyl methacrylate, 5 percent by weight of the cyan pigment copper tetra-4(octadecyl sulfonomido), and 20 percent by weight of the charge enhancing additive di-para-toluene sulfonimide prepared in accordance with Example I. The resulting toner composition was then micronized by jetting and triboelectric measurements were accomplished by mixing this toner composition 1 part, with 200 parts of a nickel berry carrier, such measurements being accomplished on a charge spectrograph. Triboelectric measurements were also accomplished for identically prepared toners with the exception that they did not contain the charge enhancing additive di-para-toluene sulfonimide.

A second colored toner composition was prepared by repeating the above procedure with the exception that in place of the cyan pigment there was mixed with the toner resin particles 5 percent by weight of the magenta pigment 2,9-dimethylquinacridone, there thus results a magenta toner composition.

A yellow toner composition was then prepared by repeating the above procedure with the exception that in place of the cyan pigment there was incorporated into the resin particles 5 percent by weight of the yellow pigment 2,5-dimethoxy-4-sulfonanilide phenylazo-4'-chloro-2,5-dimethoxyaceto-acetanilide.

Both the magenta toner composition, and the yellow toner composition, were formulated into developers by mixing these compositions with 2 percent by weight of a nickel berry carrier. Triboelectric measurements were accomplished on the resulting developer compositions by repeating the above procedure with regard to the cyan toner composition.

The charge spectrograph selected for the measurements uses electric and viscous forces in a uniform airflow to displace the toner particles in proportion to their charge to diameter ratio. The displaced toner particles are collected on filter paper, and this paper is then automatically scanned to determine the number of particles of each size and charge.

The average charge to diameter ratio Q/D measured in femtocoulombs per micron at 10 microns, is reported in the following Table. This table also provides S or sharpness data reported as the ratio of the average charge on the toner particles to a standard deviation, for 10 micron toner particles. Sharpness is a measure of the degree to which all the toner particles have an acceptable charge; and distributions with an S of 3 or above can be expected to have few uncharged toner particles.

The admix time in minutes is a measure of how long it takes an additional 1 percent amount of uncharged toner to mix in, and gain the same charge as a 2 percent concentration of previously charged toner particles. Generally, this time should be in the 1 minute range or below for acceptable high speed machine performance.

As noted from the results contained in the Table, the addition of a para-toluene sulfonimide increases the charge level by about 20 percent, while maintaining the S values well within an acceptable range. Of significance is the reduction in admix times, from unacceptable long admix times, to acceptable admix times for toners containing the para-toluene sulfonimide charge enhancing additive. Also, toners containing the sulfonimide charge enhancing additive had a negative triboelectric charge. Thus, a Q/D of −2.20 corresponds to a triboelectric value of about −44 microcoulombs per gram of toner.

TABLE I

| Toner Pigment | Toner Additive | Q/D(10μ) | S(10μ) | Admix Time (Min) |
|---|---|---|---|---|
| 1. Yellow | None | −(1.85) | 2.0 | 5.0 |
| 2. Yellow | di-p-toluene sulfonimide | −(2.20) | 4.2 | 2.0 |
| 3. Cyan | None | −(2.85) | 8.4 | 3.0 |
| 4. Cyan | di-p-toluene sulfonimide | −(3.38) | 6.0 | 1.0 |
| 5. Magenta | None | −(1.22) | 7.7 | 20.0 |
| 6. Magenta | di-p-toluene sulfonimide | −(1.57) | 6.0 | 1.0 |

EXAMPLE III

There was prepared a red toner composition by melt blending followed by mechanical attrition, which toner composition contained 5 percent by weight of the red pigment Lithol Scarlet red 48:1, CI 15865:1, the barrium salt of 4-amino-2-chloro-toluene-5-sulfonic acid coupled to 3-hydroxy-2-naphthalene carboxylic acid, available from BASF Corporation, Holland, Michigan, 93 percent by weight of a styrene n-butyl methacrylate copolymer resin, containing 58 percent by weight of styrene, and 42 percent by weight of n-butyl methacrylate, and 2 percent by weight of the charge enhancing additive di-para-toluene sulfonimide prepared in accordance with Example I. The resulting toner composition was then micronized by jetting and a developer composition was then prepared by mixing one part of this toner composition with 200 parts by weight of carrier particles, consisting of a ferrite core coated with 0.5 percent by weight of a terpolymer of styrene, methylmethacrylate, and triethoxysilane, reference U.S. Pat. No. 3,526,533, the disclosure of which is totally incorporated herein by reference. Triboelectric measurements, and admix time measurements were then effected on this developer composition by repeating the procedure of Example I, and substantially similar results were obtained as reported in Table I.

The developer compositions of Examples I–III, containing the charge enhancing additive para-toluene sulfonimide, were then selected for the development of images in a Xerox 3300 imaging apparatus, wherein a single pass xerographic color imaging process was selected. Specifically, latent electrostatic images were formed on a positively charged amorphous selenium photoreceptor, incorporated into the Xerox 3100 imaging apparatus, and subsequent to development of these images with the developer compositions of Examples I to III containing the charge enhancing additive, there resulted cyan, magenta, and yellow images, of excellent quality and superior resolution.

Other modifications of the present invention may occur to those skilled in the art based upon a reading of the present disclosure, and these are intended to be included within the scope of the present invention.

We claim:

1. A dry negatively charged toner composition comprised of resin particles, pigment particles, and from about 0.1 to about 10 weight percent of a negative charge enhancing additive, of the formula

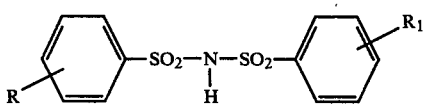

wherein R and $R_1$ are independently selected from the group consisting of alkyl, halogen, nitro, and hydrogen.

2. A toner composition in accordance with claim 1, wherein the alkyl groups contain from about 1 to about 25 carbon atoms, and the halogen is chloride, fluoride, or bromide.

3. A toner composition in accordance with claim 1, wherein R and $R_1$ are hydrogen.

4. A toner composition in accordance with claim 1, wherein R and $R_1$ are p-methyl.

5. A toner composition in accordance with claim 1, wherein the resin particles are comprised of a styrene methacrylate copolymer.

6. A toner composition in accordance with claim 1, wherein the pigment particles are cyan, magenta, yellow, or mixtures thereof.

7. A toner composition in accordance with claim 6, wherein the cyan pigment is copper tetra-4(octadecyl sulfonomido).

8. A toner composition in accordance with claim 6, wherein the magenta pigment is 2,9-dimethylquinacridone.

9. A toner composition in accordance with claim 1, wherein the yellow pigment is 2,5-dimethoxy-4-sulfonanilide phenylazo-4'-chloro-2,5-dimethoxyacetoacetanilide.

10. A toner composition in accordance with claim 1, wherein the pigment particles are carbon black.

11. A toner composition in accordance with claim 1, wherein the resin particles are present in an amount of from about 75 percent by weight to about 95 percent by weight.

12. A developer composition comprised of resin particles, pigment particles, carrier particles, and from about 0.1 percent by weight to about 10 percent by weight of the negative charge enhancing additive of claim 1, wherein R and $R_1$ are independently selected from alkyl groups, halogen, nitro, and hydrogen.

13. A developer composition in accordance with claim 12, wherein R and $R_1$ are alkyl groups containing from about 1 to 25 carbon atoms, and the halogen is chloride, fluoride, or bromide.

14. A developer composition in accordance with claim 12, wherein R and $R_1$ are hydrogen.

15. A developer composition in accordance with claim 12, wherein the resin particles are comprised of a styrene butyl methacrylate co-polymer.

16. A developer composition in accordance with claim 12, wherein the carrier particles consist of a steel core coated with a terpolymer of styrene, methyl methacrylate, and a silane.

17. A developer composition in accordance with claim 12, wherein the pigment particles are carbon black.

18. A developer composition in accordance with claim 10, wherein the pigment particles are cyan, magenta, and yellow, or mixtures thereof.

19. A developer composition in accordance with claim 18, wherein the cyan pigment is copper tetra-4(octadecylsulfonomido).

20. A developer composition in accordance with claim 18, wherein the magenta pigment is 2,9-dimethylquinacridone.

21. A developer composition in accordance with claim 18, wherein the yellow pigment is 2,5-dimethoxy-4-sulfonoanilidephenylazo-4'-chloro-2,5-dimethoxyaceto-acetanilide.

22. A method for developing electrostatic latent images comprising forming a positive electrostatic latent image on an inorganic photoresponsive device, contacting the resulting image with a dry negative charged toner composition comprising resin particles, pigment particles, and from about 0.1 percent by weight to about 10 percent by weight of a negative charge enhancing additive of the formula:

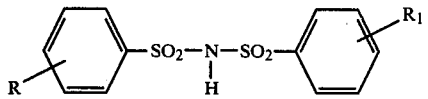

wherein R and $R_1$ are independently selected from the group consisting of alkyl, halogen, nitro and hydrogen, followed by transferring the image to a suitable substrate, and permanently affixing the image thereto.

23. A method for imaging in accordance with claim 22, when the pigment particles are comprised of cyan, magenta, and yellow pigments or mixtures thereof, and there results color images.

24. A method of imaging in accordance with claim 22, wherein R and $R_1$ are hydrogen.

25. A method of imaging in accordance with claim 22, wherein there is added thereto carrier particles consisting of a steel core coated with a terpolymer of styrene, methacrylate, and a silane.

26. A method of imaging in accordance with claim 22, wherein the resin particles are comprised of a styrene butyl methacrylate copolymer resin.

27. A toner composition in accordance with claim 1, wherein the pigment particles are comprised of magnetite.

28. A toner composition in accordance with claim 27, wherein the magnetite is a mixture of iron oxides.

29. A toner composition in accordance with claim 1, wherein the pigment particles are comprised of carbon black and magnetite.

30. A developer composition in accordance with claim 12, wherein R and $R_1$ are p-methyl.

31. A method of imaging in accordance with claim 22, wherein R and $R_1$ are p-methyl.

* * * * *